US005655448A

United States Patent [19]

Junghans

[11] Patent Number: 5,655,448

[45] Date of Patent: Aug. 12, 1997

[54] SAFETY DEVICE AT A ROTARY PRINTING MACHINE

[75] Inventor: Rudi Junghans, Wilhelmsfeld, Germany

[73] Assignee: Heidelberger Druckmaschinen AG, Heidelberg, Germany

[21] Appl. No.: 535,547

[22] Filed: Sep. 28, 1995

Related U.S. Application Data

[63] Continuation of Ser. No. 192,549, Feb. 7, 1994, abandoned.

[30] Foreign Application Priority Data

Feb. 6, 1993 [DE] Germany ..... 9301640 U

[51] Int. Cl.[6] ..... B41F 5/00

[52] U.S. Cl. ..... 101/216; 49/385; 182/113

[58] Field of Search ..... 101/212, 216, 101/181, 480, 130, 150, 171, 494; 182/112, 113; 49/49, 385

[56] References Cited

U.S. PATENT DOCUMENTS

| | | | |
|---|---|---|---|
| 1,207,920 | 12/1916 | Howe | 49/385 |
| 3,232,376 | 2/1966 | Lucas et al. | 182/113 |
| 3,752,261 | 8/1973 | Bushnell, Jr. | 182/113 X |
| 4,041,646 | 8/1977 | Mittag | 182/112 X |
| 4,185,716 | 1/1980 | Rinehart | 182/113 X |
| 4,897,960 | 2/1990 | Barvinek et al. | 49/49 |

*Primary Examiner*—Christopher A. Bennett
*Attorney, Agent, or Firm*—Herbert L. Lerner; Laurence A. Greenberg

[57] ABSTRACT

A safety device is provided at a rotary printing machines. The printing machine includes printing units which comprise at least two printing mechanisms disposed one above the other. The upper printing mechanism is accessible from a pivotable work platform which can be reached via a ladder disposed laterally at the printing units. The improvement lies in a pivotable safety arm which yields obliquely upwardly in response to a contact force applied from below.

10 Claims, 3 Drawing Sheets

SAFETY DEVICE AT A ROTARY PRINTING MACHINE

This application is a continuation of application Ser. No. 08/192,549, filed Feb. 7, 1994, now abandoned.

BACKGROUND OF THE INVENTION

1. Field of the Invention

The invention relates to a safety device at rotary printing machines, the printing units of which include at least two printing mechanisms disposed above one another and wherein the upper printing mechanism is accessible from a pivotable work platform which can be reached via a ladder laterally disposed at the printing units.

2. Description of the Related Art

Page 12/5 in the house magazine "Heidelberg Web" of the firm Heidelberger Druckmaschinen Aktiengesellschaft of Germany, dated Apr. 1, 1989, under the header "Zweiter Falzapparat" (second folder), shows a work platform belonging to a turning bar superstructure above two folder cylinder members. The platform can be reached via a staircase and it is secured by a railing. The railing is interrupted by a railing section which pivots horizontally. The pivoting range is disposed in a vertically defined plane and it is thus very space demanding; furthermore, in opening the pivotable railing, one must step back quite far, which substantially reduces the usable space on the superstructure platform.

SUMMARY OF THE INVENTION

It is accordingly an object of the invention to provide a safety device at a printing machine, which overcomes the hereinafore-mentioned disadvantages of the heretofore-known devices of this general type and which optimizes a safety device for the press operator in such a manner that the ascension to and the stepping onto the platform is not impeded, while maximum safety is provided during the presence of the press operator or maintenance personnel on the platform.

With the foregoing and other objects in view there is provided, in accordance with the invention, an improvement in a rotary printing machine having a printing unit with at least two printing mechanisms disposed one above the other, a work platform for access to an upper printing mechanism, and a ladder disposed at the printing unit via which the work platform can be reached. The improvement is found in a safety device for the work platform, comprising:

a pivotable safety arm and means for limiting a pivoting motion of the pivotable safety arm to a direction obliquely upwardly in response to a contact force applied on the safety arm from below.

In other words, the primary object of the invention is solved in that a pivotable safety arm yields obliquely upwardly in response to a contact force approaching from below, for instance applied by the shoulder and the hips of a press operator.

Any actuation of the safety arm is therefore only possible in an advantageous manner when a person accesses the platform. Since the yield movement of the safety arm is defined in an obliquely upwardly oriented plane, one need not step back from the edge of the platform as far when leaving the platform. Since the yield movement of the safety arm is effected only by contact force from below, the safety arm is pivoted upwardly only when a person approaches the platform from below, for instance by the shoulder of the person. Once the person has stepped onto the platform, any unintentional upward pivoting of the safety arm can no longer occur.

In accordance with an added feature of the invention, the printing unit has a maintenance side, the pivotable safety arm being mounted at the maintenance side of the printing unit.

In accordance with another feature of the invention, the printing unit defines a direction of paper travel, and the limiting means include a bearing attaching the pivotable safety arm to the printing unit, the bearing being rotated relative to a horizontal so as to allow a pivot direction of the safety arm obliquely relative to the horizontal. Preferably the inclination may be up to about 45° from the horizontal.

In accordance with a concomitant feature of the invention, the limiting means allow the pivotable safety arm to automatically pivot back into a substantially horizontal safety position when the contact force is not applied from below.

In other words, the safety arm is preferably disposed at the service side or operator's side of the machine units. The safety arm is received in a bearing such that, in the rest or safety position, it extends parallel to a paper travel direction. The bearing is rotated by up to 45° relative to the horizontal. After actuating the pivotable safety arm, the same automatically pivots back into the safety position by virtue of its own gravitational weight.

Other features which are considered as characteristic for the invention are set forth in the appended claims.

Although the invention is illustrated and described herein as embodied in a safety device at a printing machine, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
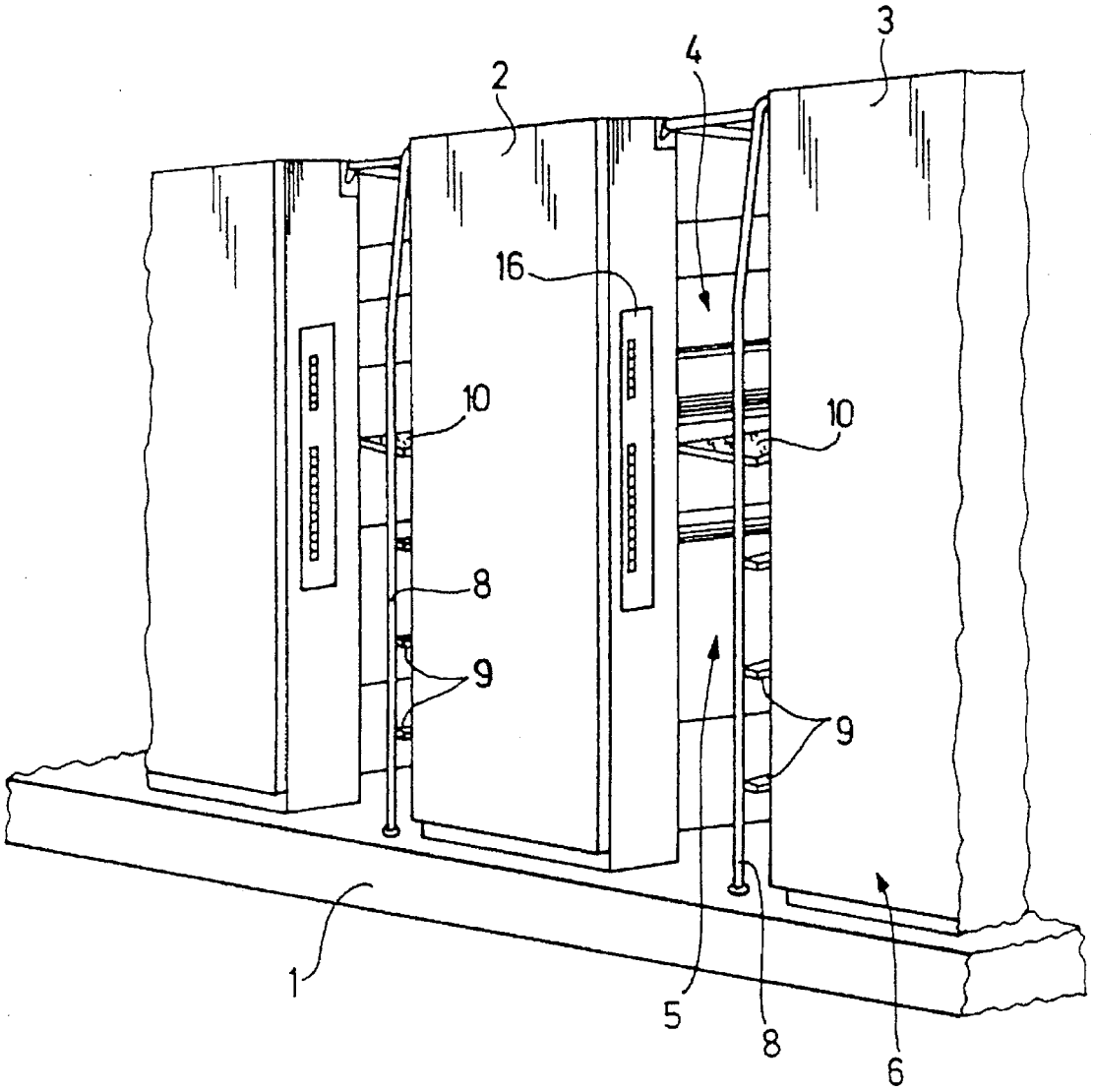
FIG. 1 is a perspective view of a work platform pivoted into the free space between two printing units.

Referring now to the figures of the drawing in detail and first, particularly, to FIG. 1 thereof, there is seen a schematic rendition of two printing units 2 and 3 erected on a foundation 1. The individual printing units are indicated herein as each being subdivided into an upper printing mechanism 4 and a lower printing mechanism 5. A pivotable work platform 10 is mounted approximately centrally between the printing mechanisms 4 and 5 at the printing unit 2. The platform 10 allows work access at the upper printing mechanism 4. The pivotable work platform 10 is accessible via a ladder 8 laterally disposed at the maintenance side 6 at the printing unit 3. An operator panel 16 is easily accessible from the platform 10.

Figure 2:
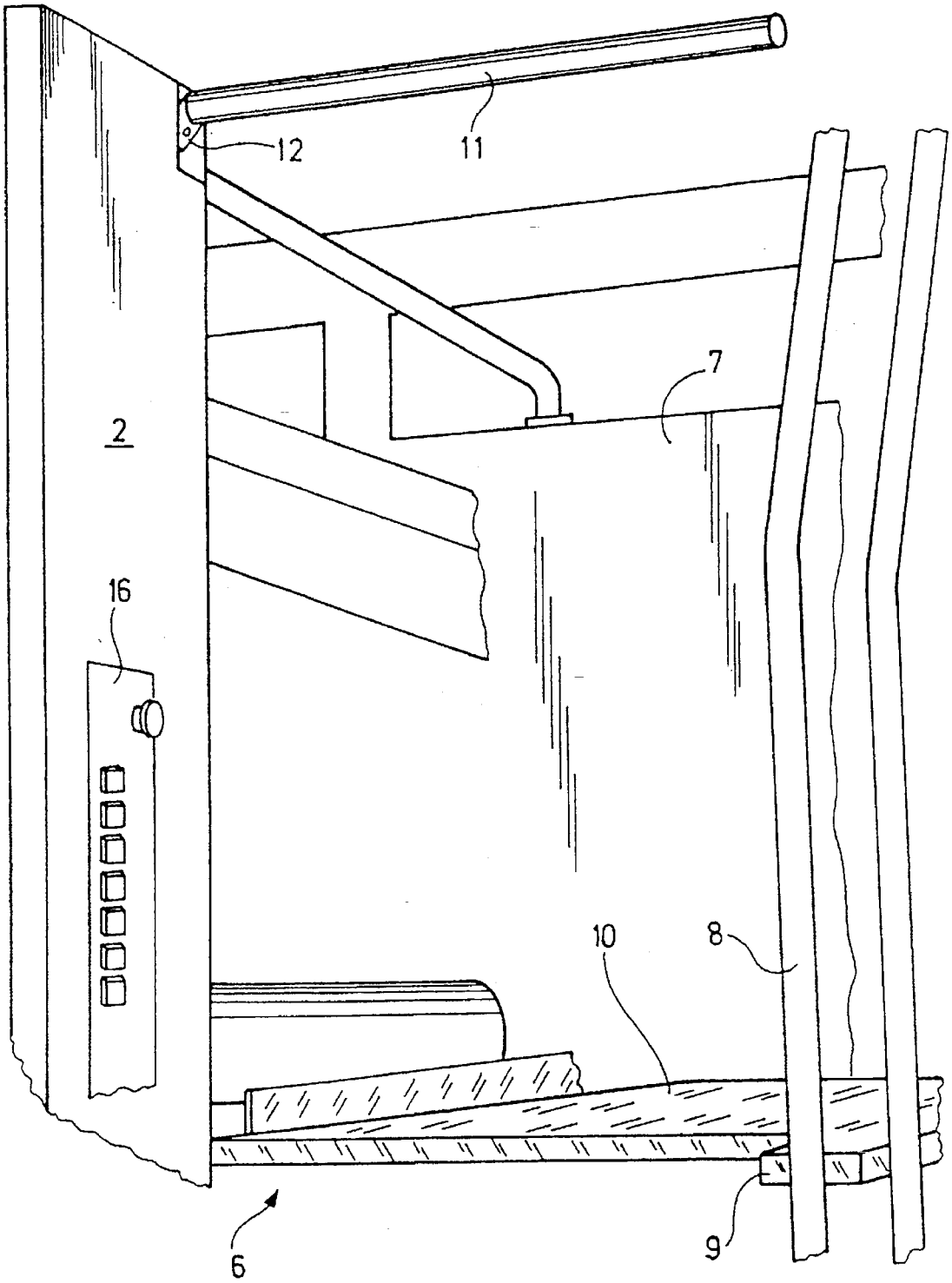
FIG. 2 is an enlarged partial view of the work space with obliquely disposed mounting of the safety arm.

Referring now primarily to FIG. 2, the press operator touches the pivotable safety arm 11 from below with his shoulder as he ascends via the ladder 8. In further ascending, the safety arm 11 is further deflected by the shoulder and then by the hips of the press operator, thus allowing uninhibited access onto the work platform 10. When the press operator no longer touches the safety arm 11, the same automatically pivots back into its safety position. Any unintentional opening of the safety arm 11 is thus no longer possible. The press operator present on the pivotable work platform 10 is thus secured by the safety arm 11 which pivots back into its safety position by virtue of its own weight. When the press operator wishes to leave the work platform 10, he approaches the safety arm 11 and pivots the same obliquely upward. Since the pivot motion of the safety arm 11 follows a plane which is oriented obliquely upward, up to about 45° relative to the horizontal, the press operator need not step back very far from the safety arm 11.

Figure 3:
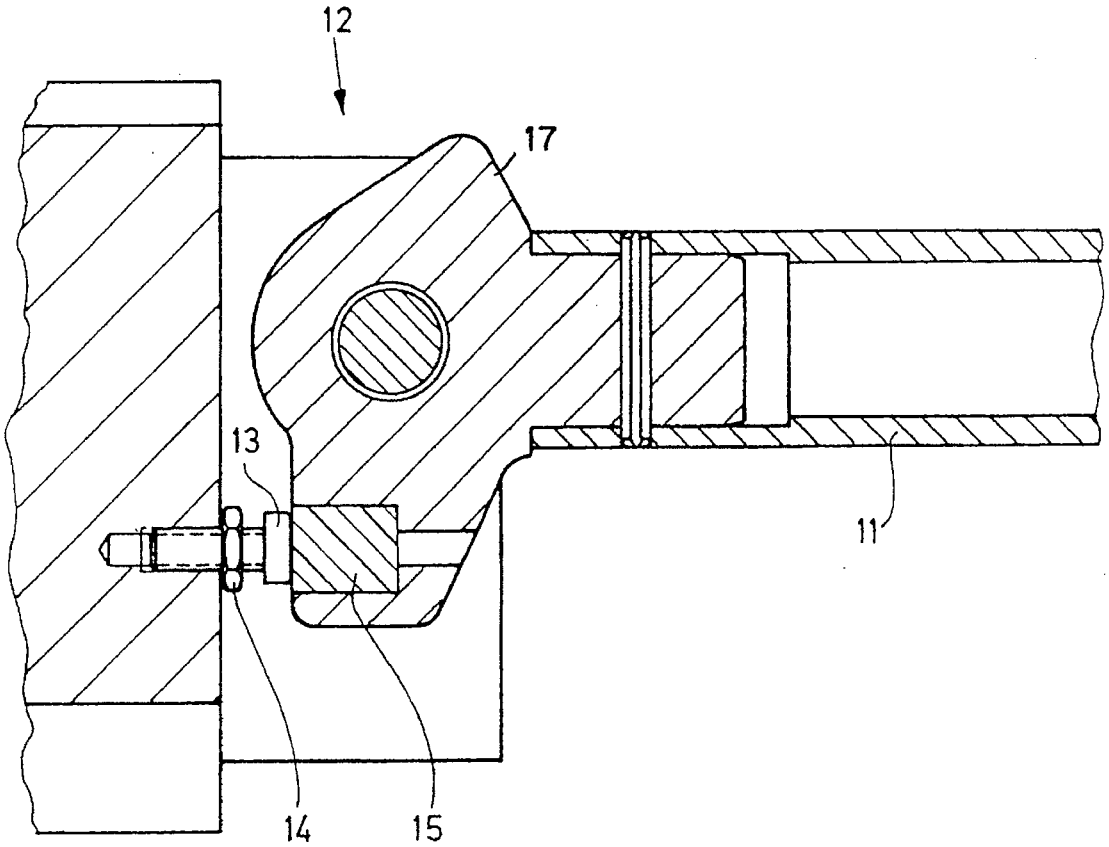
FIG. 3 is an enlarged, partial view of the bearing of the safety arm with adjusting elements.
Figure 4:
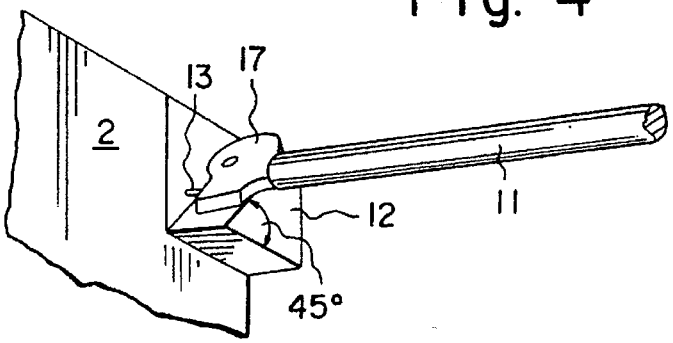
FIG. 4 is an enlarged, partial perspective view of an exemplary embodiment of the safety arm pivot bearing.

The mounting member is illustrated in FIG. 3 at which the safety arm 11 is mounted. An adjusting screw 13 and a nut 14 are provided for the purpose of equalizing tolerances and in order to enable an exactly horizontal positioning of the safety arm 11 in its rest position (safety position). A damper 15 is provided for dampening any impact clatter or vibrational noise, It should be understood that FIG. 4 is a rudamentary rendition of an exemplary embodiment of the safety arm bearing. The wedge angle of the support member 12 is shown at its preferred maximum of 45°. The limiting means is thus defined by the wedge plane upon which a stub member 17 (to which the safety bar 11 is attached) is allowed to rotate.

I claim:

1. In a rotary printing machine having a printing unit with at least two printing mechanisms disposed one above the other, a work platform for access to an upper printing mechanism, and a ladder disposed at the printing unit via which the work platform can be reached, the improvement which comprises a safety device for the work platform, comprising:

a pivotable safety arm and means for limiting a pivoting motion of said pivotable safety arm to a direction obliquely upwardly in response to a substantially vertical contact force applied on said safety arm from below.

2. The safety device according to claim 1, wherein the printing unit has a maintenance side, said pivotable safety arm being mounted at the maintenance side of the printing unit.

3. The safety device according to claim 2, wherein the printing unit defines a direction of paper travel, and said limiting means include a safety arm bearing attaching said pivotable safety arm to the printing unit, said safety arm bearing being rotated relative to a horizontal so as to allow a pivot direction of said safety arm obliquely relative to the horizontal.

4. The safety device according to claim 3, wherein the pivot direction of said safety arm is oriented up to 45° from the horizontal.

5. The safety device according to claim 1, wherein said limiting means allow said pivotable safety arm to automatically pivot back into a substantially horizontal safety position when the contact force is not applied.

6. In a rotary printing machine having a printing unit with at least two printing mechanisms disposed one above the other and a work platform for axis to an upper printing mechanism, the improvement which comprises a safety device for the working platform, comprising:

a pivotable safety arm and means for limiting a pivoting motion of said pivotable safety arm to a direction obliquely upwardly and towards the working platform in response to a substantially vertical contact force applied on said safety arm from below.

7. The safety device according to claim 6, wherein the printing unit has a maintenance side, said pivotable safety arm being mounted at the maintenance side of the printing unit.

8. The safety device according to claim 6, wherein the printing unit defines a direction of paper travel, and said limiting means include a safety arm bearing attaching said pivotable safety arm to the printing unit, said safety arm bearing being rotated relative to a horizontal so as to allow a pivot direction of said safety arm obliquely relative to the horizontal.

9. The safety device according to claim 6, wherein the pivot direction of said safety arm is oriented up to 45° from the horizontal.

10. The safety device according to claim 6, wherein said limiting means allow said pivotable safety arm to automatically pivot back into a substantially horizontal safety position when the contact force is not applied.

* * * * *